US007914011B1

(12) United States Patent
Bromer

(10) Patent No.: US 7,914,011 B1
(45) Date of Patent: Mar. 29, 2011

(54) DORSIFLEXION SKATE BRAKE

(76) Inventor: Nick Bromer, Marietta, PA (US)

( * ) Notice: Subject to any disclaimer, the term of this patent is extended or adjusted under 35 U.S.C. 154(b) by 2037 days.

(21) Appl. No.: 09/995,097

(22) Filed: Nov. 27, 2001

Related U.S. Application Data

(60) Provisional application No. 60/253,103, filed on Nov. 28, 2000.

(51) Int. Cl.
*A63C 17/14* (2006.01)

(52) U.S. Cl. ..... 280/11.211; 188/29

(58) Field of Classification Search ..... 280/11.204, 280/11.211, 11.215, 11.206, 11.212, 11.214, 280/11.216, 11.217, 11.19, 842, 11.213; 188/29, 5
See application file for complete search history.

(56) References Cited

U.S. PATENT DOCUMENTS 5,143,387 A * 9/1992 Colla ..... 280/11.207
5,183,275 A * 2/1993 Hoskin ..... 280/11.217
5,203,321 A * 4/1993 Donovan et al. ..... 128/25 B
5,232,231 A * 8/1993 Carlsmith ..... 280/11.2
5,403,021 A * 4/1995 Shifrin ..... 280/11.215
5,478,094 A * 12/1995 Pennestri ..... 280/11.207
5,527,100 A * 6/1996 O'Donnell et al. ..... 301/5.309
5,569,629 A * 10/1996 TenEyck et al. ..... 501/35
5,575,489 A * 11/1996 Oyen et al. ..... 280/11.22
5,609,346 A * 3/1997 Bellehumeur ..... 280/11.204
5,630,595 A * 5/1997 Perner ..... 280/11.216
5,704,617 A * 1/1998 Stoughton et al. ..... 280/11.214
5,758,884 A * 6/1998 Flater ..... 280/11.209
5,890,724 A * 4/1999 Gignoux et al. ..... 280/11.28
5,908,197 A * 6/1999 Strothmann et al. ..... 280/11.211
5,924,704 A * 7/1999 Johnson ..... 280/11.211
5,979,916 A * 11/1999 Gatel et al. ..... 280/11.224
5,997,015 A * 12/1999 Bellehumeur ..... 280/11.215
6,053,511 A * 4/2000 Intengan ..... 280/11.2
6,485,034 B1 * 11/2002 Chou ..... 280/11.28

* cited by examiner

*Primary Examiner* — J. Allen Shriver, II
*Assistant Examiner* — John D Walters

(57) ABSTRACT

A brake for a skate is actuated by dorsiflexion (the medical term for a foot motion that raises the toes when a person is standing) and not by plantar flexion (the opposite motion). The braking motions of the toes are thus the natural motions used to maintain balance. The actuating motion (A) moves a lifter (110) and rotates a brake shoe (150) about a pivot (130). The brake shoe preferably includes fiber-reinforced elastomer.

14 Claims, 2 Drawing Sheets

DORSIFLEXION SKATE BRAKE

CROSS-REFERENCE TO RELATED APPLICATION

Benefit is claimed of the filing date of the Provisional Patent Application entitled "Toe Dorsiflection Skate Brake" filed on Nov. 28, 2000, by the same applicant, Ser. No. 60/253,103, the whole disclosure of which (specification, drawing, claims, and abstract) is entirely incorporated herein by reference.

FIELD OF THE INVENTION

The present invention relates to brakes for skates strapped to the foot, such as in-line skates or roller skates, scooters, and similar land vehicles.

REVIEW OF THE RELATED TECHNOLOGY

According to the *Wall Street Journal*, in-line skates were associated with more than 100,000 accidents in 1995. Inefficient braking is one cause of this high accident rate.

Skate braking typically consists in dragging a brake shoe mounted on one of the skates across the pavement, and this is a poor method of stopping. (No one would stop a car by opening the door and putting a foot on the ground.)

Foot-dragging is inefficient for various reasons.

Only one foot brakes, and the non-braking foot continues to roll; while still rolling, the skater must exert a counter-torque against the twisting effect of the dragging brake pad, and otherwise stay balanced on the rolling skate, which requires that a certain amount of weight be on the rolling leg (in order to keep that skate on track); the amount of force pressing the brake pad against the ground is limited to a fraction of the skater's body weight. Since the friction force for stopping is directly proportional to the force pressing the brake pad onto the ground (Hooke's law), the skater's deceleration is also limited and the stopping distance is large.

In addition, the moving friction of a dragged brake shoe is less than the static friction of a rolling wheel (which is at rest on the pavement).

Aside from their inherent mechanical inefficiency, conventional skate brakes (and other brakes proposed by other inventors) are also awkward and unnatural to use. The motions required for braking are in many cases contrary to those naturally used to maintain balance, which involve shifting the weight forward and backward, from toe to heel and from heel to toe. A person must do this shifting constantly, whether standing, walking, or skating, or fall over. A person also does this on an unstable platform, such as the deck of a boat, to overcome accelerations and decelerations. Only in the case of large and sudden accelerations, for example on a lurching subway train, does a person need to actually move a foot to stay balanced.

The situation of a skater is much like that of a person on a boat, because changes of surface inclination and braking both involve acceleration and deceleration, and need to be countered by heel-and-toe motions.

The limitation to one-foot braking is overcome by skates with brake shoes that are lowered to the pavement by pivoting the leg at the ankle, where the ankle pivoting is in the direction that extends the toes. Brakes like this are on the market. At first glance, this seems to make sense because a person must lean backward when braking, due to the deceleration (which is, effectively, like standing on an incline). However, the final position of the foot is static, the action of rotating the foot is dynamic, and statics and dynamics involve different aspects of staying upright.

The dynamic action, of rotating the foot to extend the toes (i.e. putting the foot in line with the leg), tends to make a person fall backward. As weight passes from heels to toes, the person becomes unbalanced. A person will instinctively rotate the foot in the direction to extend the toes to counteract a forward fall. Therefore, if the braking force exerted by the skate's brake shoes increases, and the skater starts to fall forward, the natural reaction is to extend the toes more; but that increases the braking force with this type of brake. A person's ingrained reactions, used since toddling, are contrary to those needed for dynamic balance.

Because the required dynamic motion of the foot moves it away from the required final static position, it is hard to reach the required static position.

Hand-actuated skate brakes have been proposed. These of course cannot possibly require foot motions contrary to those learned in infancy. But they also cannot make use of those natural foot motions used to stay upright. As a result, they are awkward and have never become popular.

It has been proposed to actuate skate brakes with the toes. This has the advantage that the angle of the foot relative to the leg, at the ankle, can be adjusted independently of the toes' motion. However, all of the proposed systems work by curling the toe under, or else pressing downward with the toes. This action, called plantar flexion in medical terminology, has the same effect as rotating the foot at the ankle to extend the toes. It tends to tilt the person backward, and is likewise contrary to the natural motions used to maintain balance.

The ideal skate brake would be actuated by the feet, and would employ a brake-actuating motion that follows the natural motion used to maintain balance in every other situation, so that the braking motion is natural and easy to master. But this has not been done. Previous workers' foot-actuated skate brakes require motions contrary to the natural motions used for maintaining balance.

SUMMARY OF THE INVENTION

The invention is based on dorsiflexion, that is, rotation the phalanges (toe bones; singular phalanx) relative to the metatarsals (foot bones articulating with the phalanges) in the direction to lift the toes while in a standing position, or similarly of the metatarsals. In this invention, dorsiflexion is used to actuate the brake of a skate or similar vehicle. The toes can, for example, press upward against a bar, strap, piston, or other element connected to a brake preferably on the front wheel of the skate. Dorsiflexion is the opposite of plantar flexion, which was used by prior inventors to actuate a skate brake.

Dorsiflexion and plantar flexion are natural motions used by everyone, since infancy, to maintain balance by counteracting a forward or rearward tilt. The use of dorsiflexion to actuate a skate brake has the great advantage that it works the same for skate braking as for walking or standing.

When the skater becomes unbalanced by a rearward tilt, braking force should be increased so that the force of the pavement on the skate will be in the rearward direction. That will tend to push the skater's feet back under her or him, counteracting the rearward tilt of the skater's body and restoring balance. In this invention, braking force is increased by dorsiflexion, which is a natural motion when a person starts to fall backward: the weight should be shifted to the heels, and one way to do that is to lift the toes.

Conversely, whenever the braking force becomes too large and needs to be reduced, lest the skater topple forward, the skater will instinctively lower the toes (plantar flexion). That disengages the brake, reducing the braking force. Again, the natural response is the correct one because reducing the braking force in effect pushes the feet forward and counteracts the forward tilt of the skater's body.

It might be thought that the toe is incapable of exerting enough force for effective braking by dorsiflexion. However, the inventor, a man of 165 pounds, can exert more than twenty-five pounds of upward force with the toes of one foot, or, about 30% of the body weight with both feet (15% on each foot). This is analogous to pressing on the brake pedal of a typical two-ton car with a force of 1200 pounds (the ratio of braking force to moving mass is the same in both cases), and dorsiflexion is clearly sufficient for effective braking.

The use of the toe is also advantageous because the toes can be coupled to the front wheel, to brake it, through a short and direct linkage. The front wheels are where the braking force should be applied for maximum effect. When a skater decelerates during braking, weight shifts forward to the front wheels, and that is where the braking force is best exerted. In an automobile, the front brakes are stronger than the rear brakes for that reason. In the case of a skater, the shift of weight to the front wheel is more pronounced because of the skater's high center of gravity. (The invention also includes actuating other wheels, some wheels, or all the wheels, by dorsiflexion.)

BRIEF DESCRIPTION OF THE DRAWING FIGURES

DETAILED DESCRIPTION OF THE PREFERRED EMBODIMENTS

Figure 1:
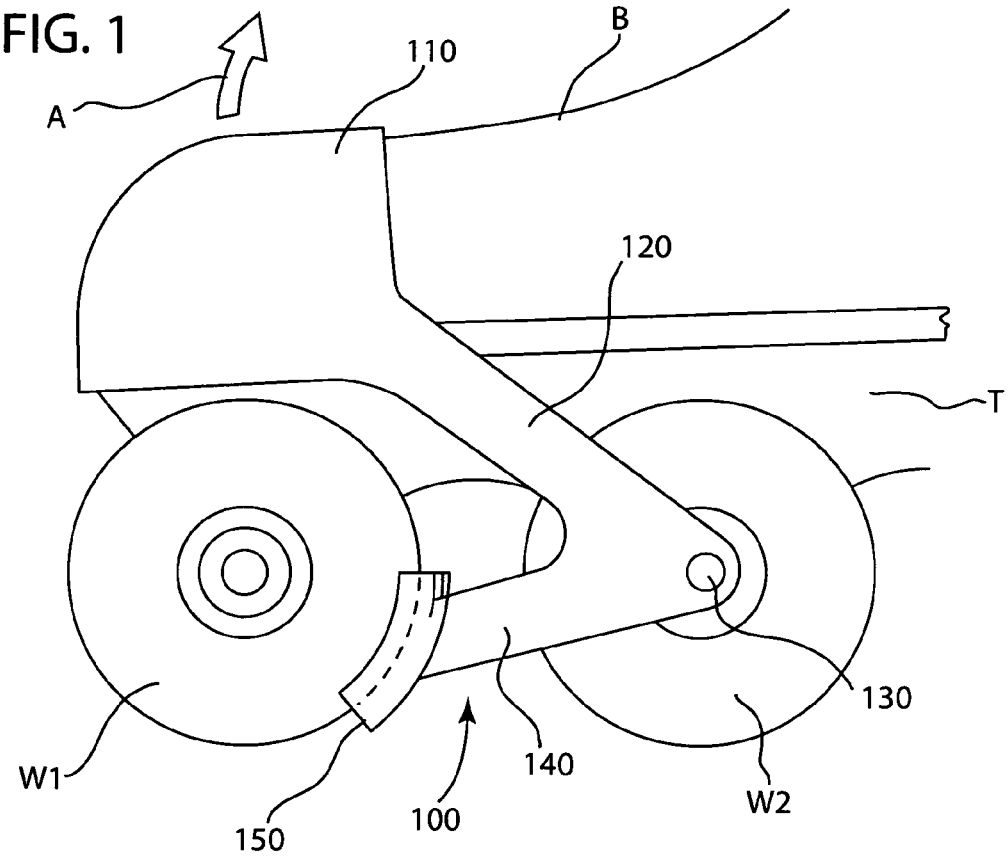
FIG. 1 is an elevational view of an in-line skate with hard toe-cap lifter.

The toes need to bear on something to exert a force. One simple device is a lifter such as a strap or padded bar provided over the toes, most preferably with an adjustable height (for different people's toes, thin or thick socks, and so on) in the non-actuated position. The lifter can also comprise the toe cap of a rigid skate shoe (this is shown in FIG. 1), again preferably with an adjustable height. The lifter is preferably hinged, with the hinge axis in some embodiments near to the joint between the metatarsals and phalanges, if the desired motion of the lifter is to follow the toe (as in FIG. 2). The hinge point can also be farther back, so that upward motion of the metatarsals will more tend to move the lifter. For hydraulic brakes, a bag filled with brake fluid, or some equivalent, can be provided as an embodiment of the lifter. The bag would be placed over the toes and under a stop attached to the skate frame or to some motion-resisting thing about the skate. The stop could optionally be fixed and the adjustment for different toes be hydraulic.

FIG. 1 shows one embodiment in which the linkage is reduced to a single pivoted arm 100. The arm is hinged on a pivot pin 130, coaxially with the axle of the second wheel W2 as shown in FIG. 1; the pivot pin could also be located above the second wheel W2, on the truck T or boot B or some extension or attached bracket, etc. (this location is not shown in FIG. 1). Extending forward and downward from the hinge pin 130 is a first arm extension 140 which terminates in a brake shoe 150, that may be curved to generally mate with the front wheel W1 as shown, to increase the contact area. The brake shoe can also be curved in the transverse plane (i.e. the surface facing the wheel W1 is somewhat toroidal) in order to slightly squeeze the rounded circumference of the wheel (this the increases braking force).

A great increase in the braking force comes from the brake shoe 150 (or, its center of applied force) being set below a line joining the axis (axle) of wheel W1 to the hinge pin 130 at the axle of wheel W2; this makes the brake still more "self-actuating" by the leverage provided.

A spring (not shown in FIG. 1) is preferably provided to insure that the brake disengages upon plantar flexion of the user's toe.

The second arm extension 120 widens to meet the edges of a toe-cap lifter 110. The toes inside (not visible in FIG. 1) press upward in dorsiflexion, causing motion as indicated by the arrow A, and that presses the brake shoe 150 against the front wheel W1. Alternatively, the lifter or arm can actuate another mechanism such as a drum brake or disc brake, or can act through a brake shoe lowered onto the ground surface, for example just behind the front-most wheel.

Alternatively, the lifter 110 could be linked to a disc- or drum-type brake, or some other type.

Figure 2:
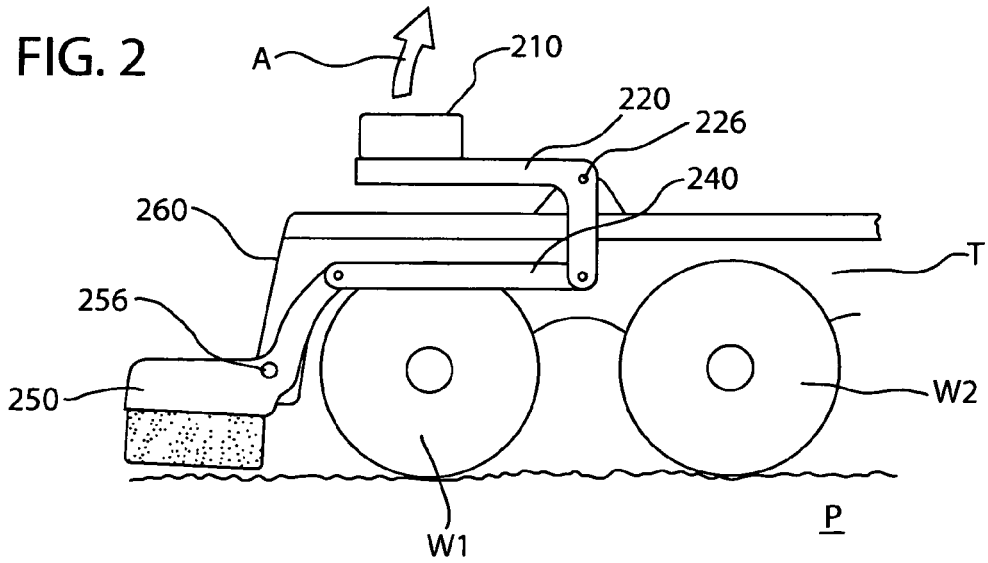
FIG. 2 is a schematic view of an in-line skate with a front brake shoe bearing on the pavement.

FIG. 2 shows an embodiment with a drag-type brake shoe and holder 250 poised over the pavement ahead of a front wheel W1. The shoe and holder 250 is pivoted on a pivot pin 256 through a truck extension 260, and the upper end is pivoted to slave arm 240 which in turn is pivoted to one arm of an L-shaped bracket 220 which is itself hinged to the truck T by a pin 226. The other, forward, arm of the bracket 220 mounts a toe strap 210 which is pressed upward, as shown by the arrow A, upon dorsiflexion.

Figure 3:
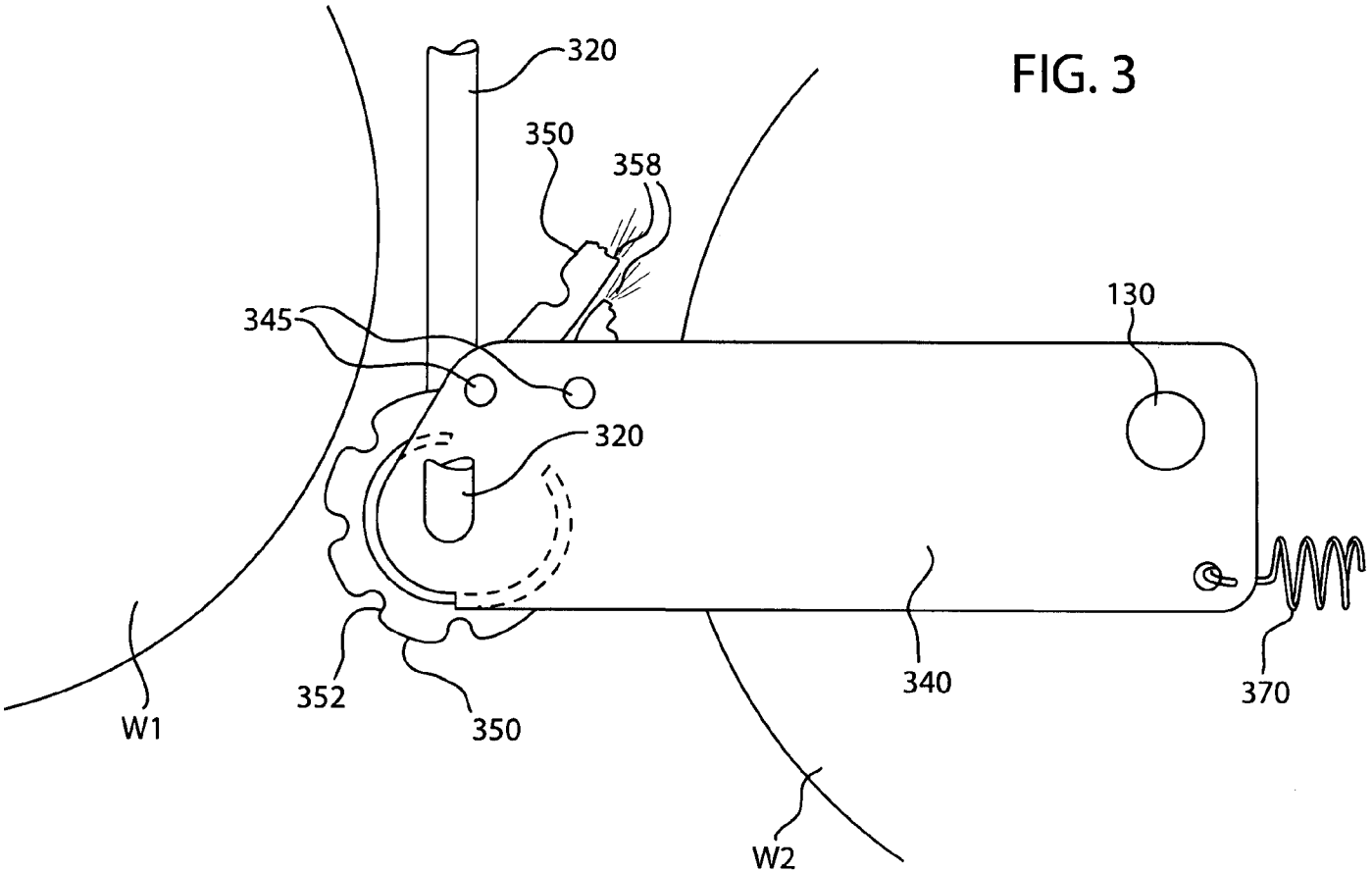
FIG. 3 is an elevational view of a preferred brake shoe for a brake of the type shown in FIG. 1.

FIG. 3 shows a preferred embodiment of the brake. It was found that elastomeric brake shoes provide a useful increase in the braking force, due to a high coefficient of friction. That increase is good because the angle of the arm extension 140 to the line defined by the wheel axes cannot be too shallow, or there is a risk of jamming that could cause an accident. Jamming is when the brake shoe is pulled up by the friction force of the wheel, which decreases the angle, which increases the force, which decreases the angle, . . . and the brake locks up. Jamming is more likely when the angle is small, and use of a high-friction brake shoe permits the angle to be increased.

However, the attachment of an elastomer brake pad to a supporting shoe presents problems because of the very high shearing force, the small size of the brake shoe, and the high curvature of the wheels. A lump of elastomer clamped in sheet metal, like the common bicycle brake shoe, may be ripped out.

The preferred brake shoe of FIG. 3 includes a fiber-reinforced elastomer belt 350, with embedded reinforcing fibers 358, that is wrapped around an internal rounded portion of a swing arm 340, preferably bent from the same sheet-metal blank that forms the arm 340, that is shown partly in hidden view by dashed line. The arm 340 pivots on the axle of the trailing wheel W2, similarly to the arm 140 of FIG. 1. The arm 340 is biased downward by a spring 370 when the brake is not actuated. It is pulled up by rods 320 coupled to the toe lift (not shown in FIG. 3) to actuate the brake. One rod 320 is cut away more closely in the front clarity.

The belt 350 is preferably of urethane (the same material as most skate wheels) because of its toughness and abrasion resistance. Urethane belts of the type illustrated in FIG. 3 are made as timing belts in a variety of sizes, with steel braid or aromatic polyamide such as KEVLAR fabric reinforcement; they are available from BRECOflex Co., LLC, of Eatontown, N.J. The belt 350 has indentations 352 that engage gear teeth when it is used as a timing belt.

During braking the belt 350 contacts the wheel W1 and tends to rotate about the rounded portion of the arm 340 in the clockwise direction because of the large force applied by wheel W1 that is rotating counter-clockwise in FIG. 3. To counteract that force, the arm 340 has holes through which are passed pins 345 that engage the indentations 352 of the belt 350. Because of the pins 345 and the fact that the belt 350 is wrapped through a large angle, the resistance to clockwise rotation of the belt 350 is greater than the force applied by the wheel W1 and it does not rotate. The belt can be repositioned when the cog protrusion bearing on the wheel W1 becomes worn, by removing and replacing the pins 345.

Alternatively, a metal arm can have an elastomer pad molded onto its end, with or without fiber reinforcement. The brake shoe may be made as a unit with the rods 320 or the arm 340. The arm 340 can comprise two disjoint arms, one on each side.

If the front wheel, or primarily the front wheel, is the braking wheel, the invention may include features that increase the force applied by the front wheel. One example is a slight reduction in the diameters of the intermediate wheels, so that the intermediate wheels press less strongly against the road and a greater force is therefore on the front wheel. A greater reduction in diameter, or the elimination of intermediate wheels, are also possible features of the invention. Alternatively, or in addition, the various wheels may be made of more-and-less resilient materials, and/or have different shapes and/or dimensions, and/or be sprung differently, to increase the force on the front wheel if it is a braked wheel. Of course, if a trailing wheel is a braked wheel then that wheel should more firmly engage the roadway for more efficient braking. Any wheel and/or any combination of wheels can be braked.

The dorsiflexion brake can be applied to a roller skate, skateboard, or other skating device whether powered or unpowered in ways analogous to the pictured embodiment applied to an in-line skate.

The illustrated embodiments are only exemplary. Any brake actuated (engaged) by dorsiflexion or an upward motion of the foot or toes is within the scope of the present invention.

The invention contemplates brake activation by any lifting action of the front portion of the foot, in addition to dorsiflexion of the toes per se. For example, a brake-actuator can be lifted by the metatarsals to apply braking force, and the invention includes a lifter farther back than the toes, for example over the metatarsals, to provide the same advantages as are provided by brake activation by dorsiflexion of the toes without upward motion of the metatarsals. A downward motion of the phalanges relative to the metatarsals, that helped to arch the foot and raise the metatarsals, would be "dorsiflexion" within the meaning of the following claims if the resulting motion of a brake actuator were upward. In the following claims, "dorsiflexion" means any upward motion of the front of the foot (forward of the ankles) and "skate" means any land vehicle that includes a foot platform, foot rest, or a place to stand. Thus, "skate" includes a scooter and a skateboard. The present invention is not limited, except by the scope of the following claims.

I claim:

1. For a user having a foot with a toe and standing on a skate, the skate including a position for the foot; a skate braking mechanism comprising:

a brake; and a lifter operatively coupled to the brake and pressable upward by a foot motion consisting of an upward rotation of at least one phalanx bone of the toe relative to at least one metatarsal bone of the foot, while the user's foot is on the position, the toe motion acting to actuate the brake;

whereby the brake is actuated according to a motion of the toe, which is not contrary to a natural motion of the toe to maintain balance of the user.

2. The skate braking mechanism according to claim 1, wherein the skate includes at least one wheel and the brake comprises a brake shoe coupled to the lifter, and wherein the brake shoe bears on the wheel of the skate when actuated.

3. The skate braking mechanism according to claim 2, wherein the brake shoe is coupled to the lifter via a linkage.

4. The skate braking mechanism according to claim 2, wherein the brake shoe is directly coupled to the lifter.

5. The skate braking mechanism according to claim 2, wherein the brake shoe comprises fiber-reinforced elastomer.

6. The skate braking mechanism according to claim 5, wherein the brake shoe comprises a portion of fiber-reinforced elastomer belt.

7. The skate braking mechanism according to claim 5, wherein the elastomer comprises urethane.

8. The skate braking mechanism according to claim 2, wherein the brake shoe comprises urethane.

9. The skate braking mechanism according to claim 1, comprising a return spring counteracting an upward pressing motion of the toe.

10. The skate braking mechanism according to claim 1, wherein the lifter is positioned above the toe forward of the metatarsals of the foot of the user.

11. The skate braking mechanism according to claim 1, wherein the lifter is pivoted to be moved upward by the toe.

12. The skate braking mechanism according to claim 11, wherein the lifter is pivoted about a pivot axis adjacent to a joint between the metatarsal bone and the phalanx bone.

13. The skate braking mechanism according to claim 1, wherein the skate includes wheels and the brake comprises a brake shoe that is pivoted to rotate about an axle of a first wheel, so as to bear against a second wheel.

14. The skate braking mechanism according to claim 1, comprising the skate.

* * * * *